United States Patent [19]

Desiderio

[11] 4,114,007

[45] Sep. 12, 1978

[54] LOW LEVEL RELAY CONTACT BLADES

[75] Inventor: Angelo C. Desiderio, Crystal Lake, Ill.

[73] Assignee: Oak Industries, Incorporated, Crystal Lake, Ill.

[21] Appl. No.: 756,247

[22] Filed: Jan. 3, 1977

[51] Int. Cl.[2] ..... H01H 1/24

[52] U.S. Cl. ..... 200/246; 200/164 R; 200/260; 200/275; 200/281

[58] Field of Search ..... 200/153 R, 153 G, 153 H, 200/153 L, 153 LA, 153 SC, 164 R, 239, 243, 245, 246, 247, 250, 271, 272, 275, 281

[56] References Cited

U.S. PATENT DOCUMENTS

| | | | |
|---|---|---|---|
| 1,950,556 | 3/1934 | Jackson | 200/246 |
| 2,532,468 | 12/1950 | Sweger | 200/246 |
| 2,787,687 | 4/1957 | Hall | 200/246 |
| 2,874,251 | 2/1959 | Dreyfus | 200/246 |

*Primary Examiner*—Ro E. Hart

*Attorney, Agent, or Firm*—Kinzer, Plyer, Dorn & McEachran

[57] ABSTRACT

A relay assembly has a flexible contact blade mounted on a contact carrier through the use of non-conductive support blocks which permit flexing of the blade as it moves with the carrier, thereby causing a wiping action between the movable and stationary contacts within the relay.

4 Claims, 2 Drawing Figures fig. 1.
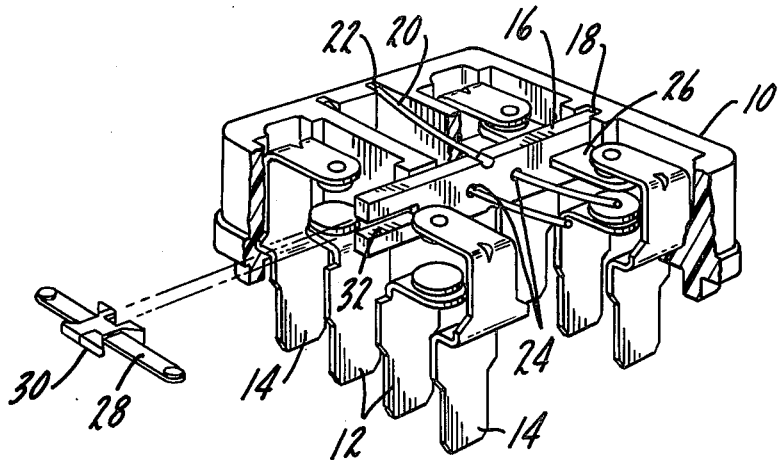
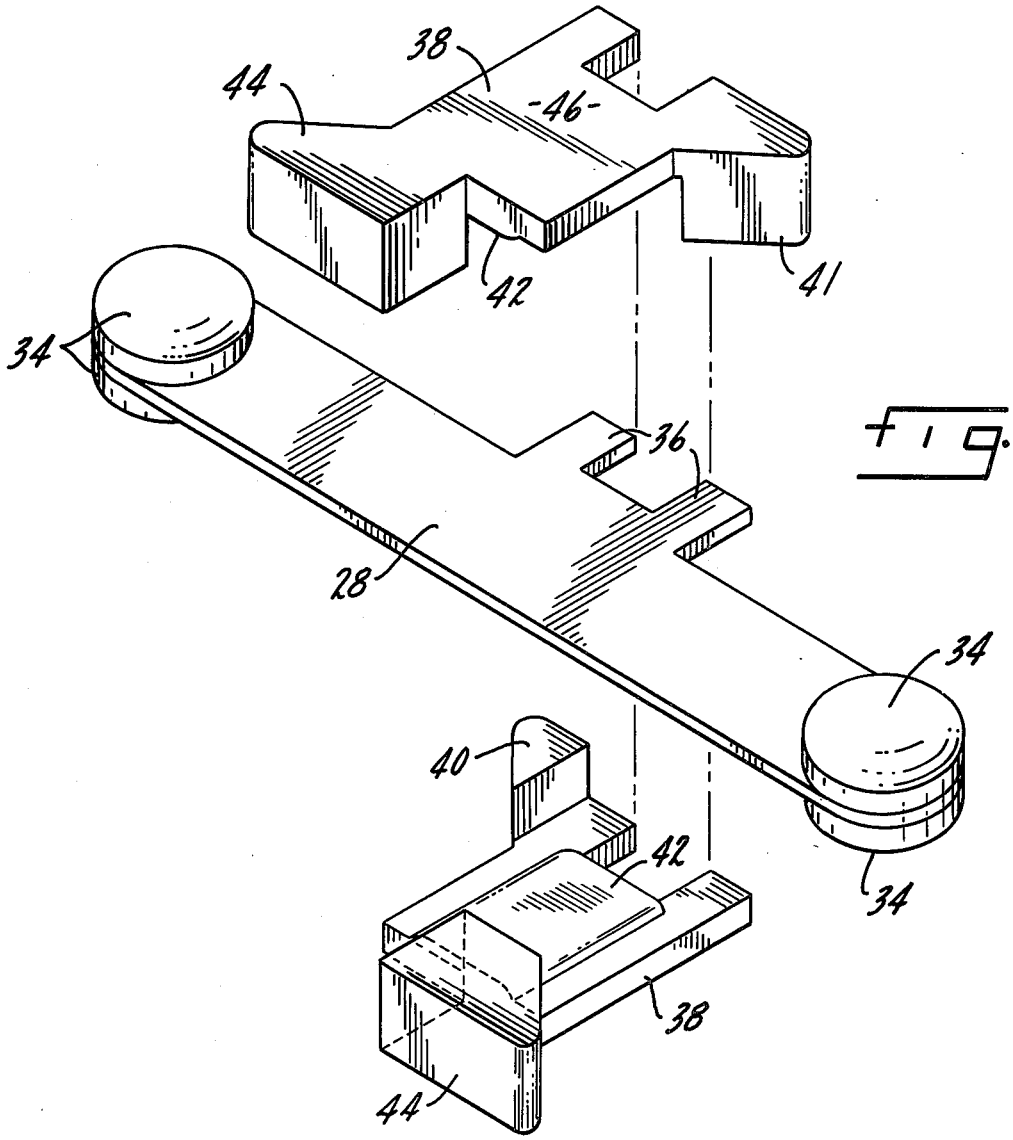
fig. 2.

LOW LEVEL RELAY CONTACT BLADES

SUMMARY OF THE INVENTION

The present invention relates to relays and in particular to a flexible contact blade and means for supporting it to provide a wiping action between the relay contacts.

Another purpose is a relay of the type described including means for supporting a flexible contact blade in a contact carrier.

Another purpose is a structure of the type described including means for interlocking the blade to support blocks which are in turn mounted within a relay contact carrier.

Another purpose is a relay structure, usable with low-level currents, which provide means for maintaining clean contact surfaces.

Other purposes will appear in the ensuing specification, drawings and claims.

DESCRIPTION OF THE DRAWINGS

The invention is illustrated diagrammatically in the following drawings wherein:

FIG. 1 is a diagrammatic illustration of a relay of the type described, and

FIG. 2 is an enlarged perspective, in exploded form, illustrating the contact blade and its support blocks.

DESCRIPTION OF THE PREFERRED EMBODIMENT

It is a continuing problem in relays to maintain clean contacts so as to provide current continuity through the contacts. The silver which is used in most relay contacts will oxidize with time and the oxidized layer of silver must in some manner be removed to maintain good electrical conduction. In relays carrying high levels of current, the normal arcing between the movable contact bar and the stationary contacts at opening and closing provides adequate removal of the oxidized silver. However, in relays carrying low level currents, other means must be provided to maintain clean contacts. The present invention is particularly directed to a relay in which a flexible contact blade is used in those portions of the relay which will carry low level currents, with the flexible contact blade providing a wiping and cleaning action, thus maintaining a continuous current path through the relay contacts.

In FIG. 1 a relay housing is indicated generally at 10 and there may be a plurality of terminals positioned within the housing. The terminals may be of two types, lower terminals 12 and upper terminals 14. The terms "upper" and "lower" are only used to describe terminals which are positioned above or below the contact blade or contact bar. A contact carrier 16 has its opposite ends positioned in grooves 18 in housing 10, and is yieldingly mounted within the housing by spring members 20, the opposite ends of which are positioned within grooves 22 formed in the walls of housing 10. Springs 20 pass through openings 24 in the contact carrier thereby yieldingly supporting the carrier with the housing. Although not shown herein, carrier 16 will customarily be moved by an armature forming a part of the relay with the armature moving in response to an activating current passing through an adjacent coil. As such structure is conventional in the art, it is not shown herein.

The right-hand side of the relay assembly in FIG. 1 includes a contact bar 26 of the usual type used in high level current applications. Bar 26 passes through a groove in the contact carrier and is moved back and forth between the contact portions of upper and lower terminals 12 and 14 in response to current through the relay coil. With a high level of current, in contrast to rather low levels, for example a few milliamperes, which may be used in other portions of the relay to be described, there will usually be arcing between the contact portions of bar 26 and the contact portions of terminals 12 and 14 with such arcing being used to remove oxidation formed on the contact portions.

At the left side of the relay there is a flexible contact blade 28 held by a support structure 30 with the support structure and blade being positioned within a groove 32 in the left-hand end of contact carrier 16. Blade 28 will move with the contact carrier back and forth between the contact portions of terminals 12 and 14, again in response to current through the relay coil.

It should be understood that there may be one or more flexible blades within a particular relay assembly. For purposes of illustration only, one such blade is shown herein.

FIG. 2 illustrates the details of blade 28 and its support structure. Blade 28 may have contact portions 34 on opposite sides and at opposite ends thereof, thus forming four separate contact portions which cooperate with terminals 12 and 14 to control the passage of current through the relay. Blade 28 is formed of a thin flexible material and has a pair of laterally extending projections 36 generally at the center thereof.

Support structure 30 includes a pair of non-conductive preferably plastic, support blocks 38 which are identical in construction. Looking at the lower block in FIG. 2, there is an outwardly and laterally extending ear 40 which defines one side of a pocket for positioning one of projections 36, in this case the left hand projection. There is a similar ear 41 on the upper block which will form a pocket for the right hand projection 36 with the result that the projections 36 and ears 40 and 41 are effective to interlock the two support blocks to the contact blade. There is generally central raised area 42 on each support block which is in contact with the flat surface of blade 28 when the support blocks are mounted on opposite sides of the blade. Raised areas 42 support and permit flexing and a small degree of pivotal movement of the blade during its movement with the contact carrier. Each of the support blocks further have somewhat wedge-shaped areas 44 which are arranged side by side, when the support blocks are assembled on the blade, as shown particularly in FIG. 1. Areas 44 and ears 40 and 41 cooperate to hold blade 28 against lateral movement. When the two blocks are assembled, the wedge-shaped area of one block cooperates with outer surface 46 of the other block to form upper and lower bearing surfaces. These bearing surfaces are positioned against the sides of groove 32 in contact carrier 16 and thus serve to hold the blade structure within the carrier.

In use contact carrier 16 will move back and forth in response to current through its associated coil and movement of the armature of the relay to cause blade 28 to move between terminals 12 and 14. As the blade is flexible, movement of the blade and its associated contact portions 34 into contact with the terminals will cause the contact portions 34 to wipe across similar contact portions of the terminals. This wiping action is effective to remove oxidation or other impurities on the surface of the contact portions of both the terminals and contact blade thus maintaining such contact portions in a relatively impurity-free condition. The blade may pivot slightly as it wipes across the terminals and is somewhat loosely held by raised areas 42.

The flexibility of the contact blade combined with the free floating action of the contact carrier which tips and equalizes the contact pressure on both terminals, allows the relay to be equipped with a high level switching contact on one pole and a low level switching contact on the other pole.

Whereas the preferred form of the invention has been shown and described herein, it should be realized that there may be many modifications, substitutions and alterations thereto.

The embodiments of the invention in which an exclusive property or privilege is claimed are defined as follows:

1. In a relay assembly, a housing, a contact carrier yieldingly mounted in said housing, a plurality of terminals having contact portions thereon positioned in said housing, a flat flexible contact blade having contact portions thereon, a pair of spaced projections extending laterally outwardly from said blade, means for mounting said contact blade on said contact carrier in position for closing with said terminals, said mounting means including support means interposed between said carrier and blade and permitting flexing of said blade and wiping of said terminal contact portions by said blade contact portions as said blade opens and closes upon said terminals in response to movement of said carrier, said support means being interlocked with said blade and including symmetrically arranged blade support blocks, one positioned on each side of said blade, with said blocks and blade being positioned as a unit within a groove in said contact carrier, an outwardly extending ear on each block, with said ears being positioned outwardly of and adjacent a blade projection whereby said blade is held between said ears, each of said support blocks having a raised portion with the flat blade being captured between said raised portions permitting flexing movement of said blade relative to said blocks.

2. The structure of claim 1 further characterized in that said support blocks are formed of a non-conductive material.

3. The structure of claim 1 further characterized in that said blade contact portions are positioned on the outer ends of said blade.

4. The structure of claim 1 further characterized by and including locking areas on each support block positioned against the side of said blade opposite said blade projections, with said blade being held between said ears and said locking areas.

* * * * *